United States Patent [19]

Menzi et al.

[11] 3,972,404

[45] Aug. 3, 1976

[54] TYPEWRITER SHIFT MECHANISM

[75] Inventors: Ulrich Menzi, Yverdon; Raymond Clavel, Oulens, both of Switzerland

[73] Assignee: Hermes Precisa International S.A., Yverdon, Switzerland

[22] Filed: Oct. 3, 1974

[21] Appl. No.: 511,931

[30] Foreign Application Priority Data

Oct. 12, 1973 Switzerland ..... 14514/73

[52] U.S. Cl. ..... 197/71

[51] Int. Cl.[2] ..... B41J 25/24

[58] Field of Search ..... 197/71, 48–59

[56] References Cited

UNITED STATES PATENTS 3,565,231 2/1971 Dannatt ..... 197/71

*Primary Examiner*—Paul E. Shapiro

*Attorney, Agent, or Firm*—Emory L. Groff, Jr.

[57] ABSTRACT

Depressing the upper case shift key lever pivots a balance beam from a first to a second position, thereby raising the lower case shift lever to an inactive position. When the upper case shift key lever is released, the balance beam is returned to its first position, causing the lower case shift lever to fall to its active position.

3 Claims, 2 Drawing Figures

TYPEWRITER SHIFT MECHANISM

The invention relates to a shift mechanism for typewriters having a carriage carrying a type head, the carriage shift commands being given by two interposers, one for the upper case and one for the lower case letters, one interposer being in the active position when the other is in the inactive position, each interposer being controlled by a shift lever having a stop for moving the interposer and causing it to cooperate with drive means that place it in the active position, the shift mechanism further comprising means for interconnecting the two shift levers for controlling the interposers.

In the prior art, there are shift mechanisms of the kind in which the shift levers controlling the interposers are connected together by a complicated arrangement having, for example, transfer bars that cooperate with a horizontal arm positioned in the path of a finger of one of the interposers.

An object of the invention is a shift mechanism that is much simpler in construction.

In accordance with the invention, this object is attained by constructing the interconnection between the two shift levers in the form of a balance having a beam, the two ends of which cooperate with respective ones of the two levers.

A further object of the invention is a shift mechanism that is much simpler in construction and yet provides a simple and precise adjustment.

In accordance with the invention, this latter object is attained by providing means for adjusting the position of the beam axis with respect to the two shift levers.

Figure 1A:
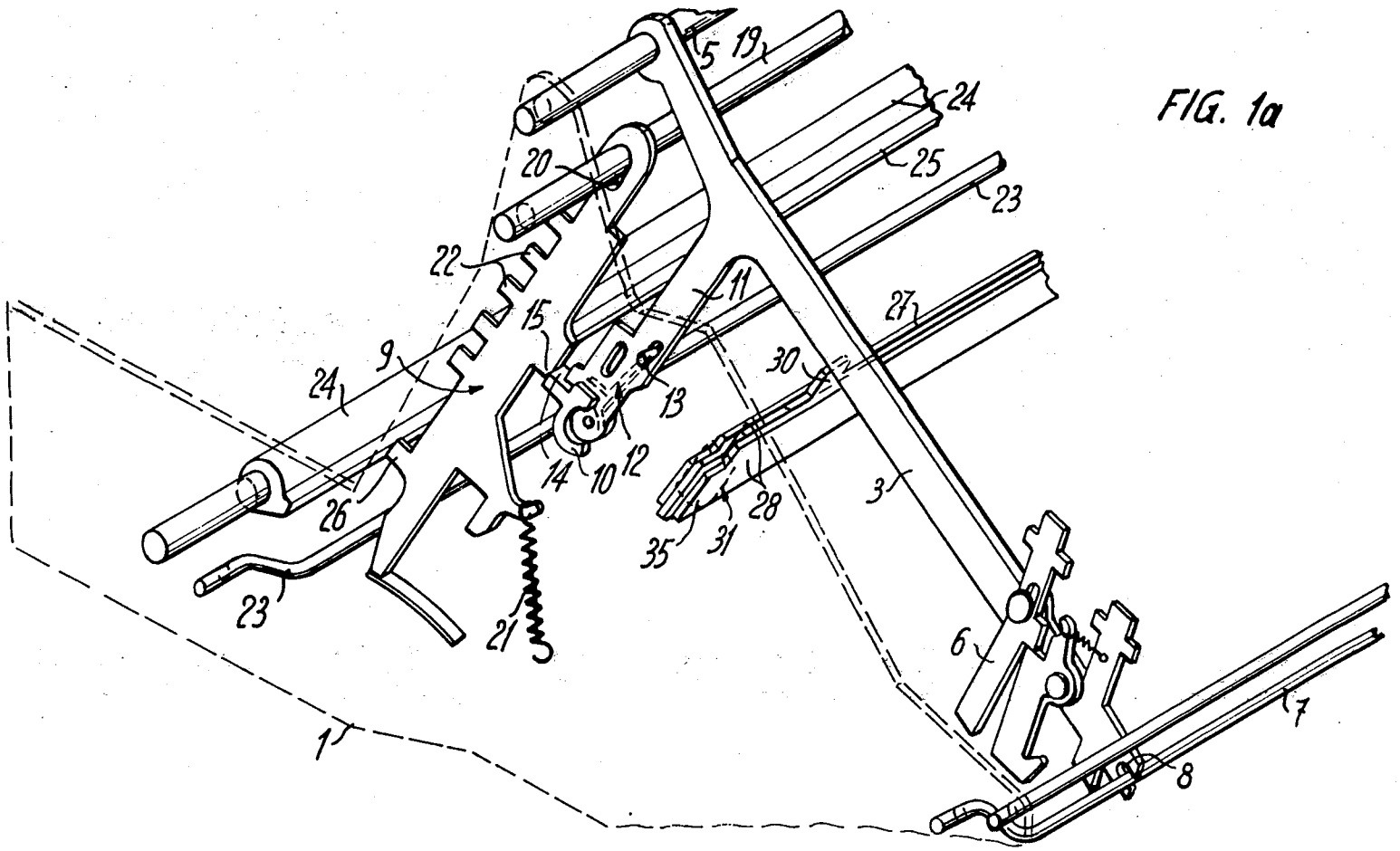
Figure 1B:
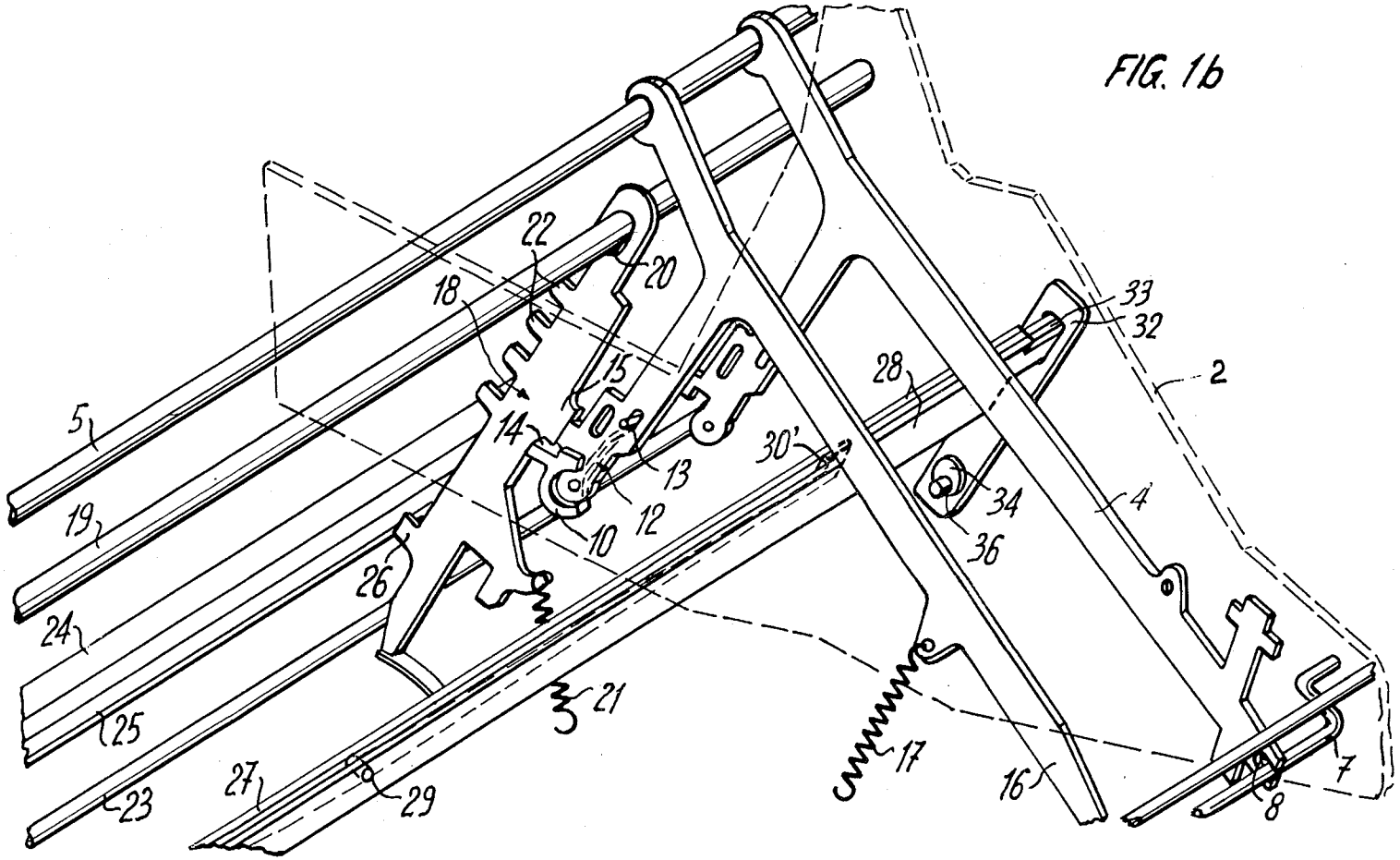

These and other objects of the invention will be apparent from the following detailed description, and from the drawings, wherein:

FIG. 1*a* is a perspective view of the left hand part of the shift mechanism, and FIG. 1*b* is a perspective view of the right hand part of the shift mechanism.

With reference to the drawings, the shift mechanism illustrated is intended for a typewriter having a frame, of which only the left and right side walls 1 and 2, shown in broken line, are visible. The typewriter is the kind that has a carriage incorporating a type head, or type element, that moves parallel to the platen. As these parts are well known, they are not illustrated.

The shift mechanism has a pair of shift key levers 3 and 4 controlling the shift for capitals and located respectively on the left side and the right side of the typewriter. The levers 3 and 4 are pivotally mounted on a rod 5 that spans the entire width of the typewriter and is fixed at each end in the upper part of the respective frame side wall 1 and 2. Each lever has a key, not shown, located conventionally on the left and right hand sides of the keyboard. The pair of shift levers has a shift key lever lock 6 for continuously typing in capitals. This arrangement is well known and will not be described.

The front ends of the shift levers 3 and 4 are connected together by a bail 7, which engages a slot 8 provided in each of these ends. The bail 7 is pivotally mounted in the side walls 1 and 2. Associated with the levers 3 and 4 is an interposer, or slide bar 9, corresponding to the capitals. It cooperates with the left lever 3 by means of a stop 10 pivotally connected to the lower end of the vertical arm 11 of the lever. This stop is free to pivot on the said lower end under the resilient bias of a leaf spring 12 held in a slot 13 of the arm 11. A face 14 of the stop 10 cooperates with a nose 15 of the interposer 9.

The invention further comprises a further shift lever 16 that is located near to the right lever 4, is likewise pivotally mounted on the rod 5, and is urged downward by a spring 17 fixed to the typewriter frame. An interposer, or slide bar, 18 corresponding to the small letters, is associated with the lever 16 by means of parts that are identical to those used for the left lever 3 and the interposer 9. These parts, as shown in FIG. 1*b*, are assigned the same reference numerals and are a pivotally mounted stop 10, urged by a leaf spring 12, that moves, by means of its face 14, the nose 15 of the interposer 18.

Each of the interposers 9 and 18 is vertically mounted on rod 19 that passes through an elongated hole 20 incorporated in the upper end of each interposer. The rod 19 is fixed to the side walls 1 and 2 and extends parallel to the rod 5. Because of the elongated hole 20, each interposer is free to slide up and down through a stroke corresponding to the length of the elongated hole. Each interposer moves under the downward bias of a return spring 21. Each interposer incorporates, in a known manner, a series of teeth 22, that operate bails, not shown, for transmitting to the carriage the various coded shift commands. The interposers 9 and 18 also cooperate with a bail 23 pivotally mounted in the side walls 1 and 2. The bail 23 operates a preselection shaft, or filter shaft, 24 by means of a connecting gear, not shown. The filter shaft 24 turns in the side walls 1 and 2 and spans the entire width of the typewriter. It comprises a longitudinal nose 25 that cooperates with a finger 26 incorporated at the lower part of each interposer 9 and 18.

The shift mechanism also comprises a balance constituted by a beam 27 in a cage composed of two parallel flat members 28 and pivoting on a pin 29 carried by these members. Each end of the beam 27 has a stop 30 or 30' that cooperates respectively with the shift levers 3 and 16.

The left end 35 of the balance cage pivots in a slot 31 incorporated in the left side wall 1. The right end 33 of the balance cage is connected to a push rod 32 that is movable by an eccentric 34 mounted on the right side wall 2. The position of the eccentric can be adjusted by means of an adjusting screw 36 the head of which is accessible from outside of the typewriter.

The invention described operates in the following manner:

When the typist pushes down the two upper case shift key levers 3 and 4 to the active position, by depressing the left or right shift key of the keyboard, the stop 10 of the lever 3 causes the upper case interposer 9 to pivot slightly rearward on the rod 19. While this movement occurs, the interposer 9 causes the bail 23 to pivot, thereby turning the filter shaft 24 for one revolution. The nose 25 of the shaft raises the interposer 9 to the maximum permitted by the elongated hole 20, whereby the said interposer transmits to the carriage, by means of the teeth 22 and the corresponding bails, the coded commands required for the upper case shift. After rotating about 30° the nose 25 moves out from under the finger 26, and the interposer 9 is pulled down by the spring 21. The nose 15 of the interposer consequently presses down on the face 14 of the stop 10, which pivots counter clockwise, thereby tensioning the leaf spring 12.

While the left lever 3 is depressed, it presses against the stop 30 at the left end of the beam 27, so that the latter pivots on its pin 29, thereby causing the right stop 30' to raise the lower case shift lever 16 to the inactive position against the force of the spring 17. The stop 10, and consequently the face 14 of the lever 16, is returned by the leaf spring 12 to its rest position, ready for a new operation.

When the lever 3 or 4 is released to return to the inactive position, the beam 27 pivots clockwise, because the lever 16, which bears on the right stop 30', is pulled down by the spring 17 to the inactive position. A sequence of steps corresponding to those caused by depressing lever 3 is started by the action of the spring 17. The interposer 18 is moved in the same way by the stop 10 of the lever 16 and transmits its coded commands to the carriage.

It should be noted that by adjusting the screw 36 of the eccentric 34, the height of the end 33 of the balance cage can be changed and consequently the position of the pivot pin 29 of the beam 27. A precise adjustment of the balance, which is done from outside of the typewriter, enables an exact positioning of the lower case lever 16. This adjustment must be so made that the lever 16, once the shift key is depressed, returns exactly to the original height of the shift key lever 3, and conversely. This precise adjustment avoids any over running of the lever 16 or 3.

It is also worth noting that, according to the invention, a single shift key provides both an upper case code, when the key is depressed, and a lower case code, when the key is released.

In accordance with the invention, the beam cage can consist of a single member 28 for mounting the balance pin 29.

Although the invention has been particularly shown and described with reference to the preferred embodiment, those skilled in the art will understand that the invention admits of changes in form and detail, aside from those already described, without exceeding the spirit and scope of the invention.

We claim:

1. In a typewriter including a shift mechanism, a frame having opposite side walls, a carriage and a type head mounted on the carriage, a first interposer for the upper case letters, a second interposer for the lower case letters, means connected to the side walls of said frame for mounting said interposers, said interposers including means for transmitting shift commands to said carriage, one interposer being in an active position when the other one is in an inactive position, a first shift lever controlling the first interposer, a second shift lever controlling the second interposer, means connected to the side walls of said frame for mounting said shift levers, drive means for moving said interposers to an active position, each of said shift levers including means for moving the corresponding interposer when said levers are moved from an inactive to an active position and cause said interposer to cooperate with said drive means, the improvement comprising a balance member including a beam with first and second ends, means on said frame side walls for mounting said balance member with the first and second ends of said beam adjacent said first and second levers, said balance member including means for pivotally mounting said beam thereon whereby when one of said levers is moved to an active position it engages the related end of said beam, causing it to pivot and move the other end of said beam against the other of said levers, causing the other of said levers to move into an inactive position, and means on one of said frame side walls acting on one end of said beam to adjust the position of the axis of said beam with respect to said first and second shift levers.

2. A shift mechanism for typewriters as defined in claim 1, wherein said adjusting means includes an adjustable eccentric member for so changing the position of said axis of said beam as to ensure that when one of said first and second shift levers is moved to said active position, the other shift lever is moved to said inactive position in response to the pivotal movement of said beam.

3. A shift mechanism for typewriters as defined in claim 1, further including support means for said beam, said support means comprising at least one support member for mounting said means for mounting said beam, said support member having first and second ends; means for holding said first end of said support member free to pivot; and wherein said adjusting means includes a movable member for holding said second end of said support member in an adjustable position to permit adjustment of said axis of said beam.

* * * * *